US010689866B2

(12) United States Patent
Baca et al.

(10) Patent No.: US 10,689,866 B2
(45) Date of Patent: Jun. 23, 2020

(54) EXTENDABLE CONSTRUCTION STANCHION

(71) Applicant: Beziup Stanchion, LLC, Arvada, CO (US)

(72) Inventors: Juan Ramon Enoch Baca, Arvada, CO (US); Karen Sue Major Baca, Arvada, CO (US); Dan Pieper, Mitchell, NE (US)

(73) Assignee: Beziup Stanchion, LLC, Arvada, CO (US)

( * ) Notice: Subject to any disclaimer, the term of this patent is extended or adjusted under 35 U.S.C. 154(b) by 274 days.

(21) Appl. No.: 15/663,040

(22) Filed: Jul. 28, 2017

(65) Prior Publication Data

US 2018/0127993 A1 May 10, 2018

Related U.S. Application Data

(60) Provisional application No. 62/497,017, filed on Nov. 7, 2016.

(51) Int. Cl.
*E04G 5/14* (2006.01)
*E04G 7/28* (2006.01)
*E04G 21/32* (2006.01)

(52) U.S. Cl.
CPC ..... *E04G 21/3233* (2013.01); *E04G 5/14* (2013.01); *E04G 7/28* (2013.01)

(58) Field of Classification Search
CPC .. E04G 5/14; E04G 5/142; E04G 7/28; E04G 21/3204; E04G 21/3223; E04G 21/3233; E04G 21/3242; E04F 2011/187; Y10T 403/32483
USPC ..... 403/109.3; 256/65.06, 65.14, 68, 69, 70, 256/DIG. 2
See application file for complete search history.

(56) References Cited

U.S. PATENT DOCUMENTS

| | | | |
|---|---|---|---|
| 1,934,000 | A | 11/1933 | Piccirilli |
| 2,706,662 | A | 4/1955 | Brown |
| 3,084,759 | A | 4/1963 | Squire |
| 3,747,898 | A | 7/1973 | Warren |
| 3,853,203 | A | 12/1974 | Werner |
| 3,867,997 | A | 2/1975 | Hyslop, Jr. |
| 4,666,131 | A | 5/1987 | Kettelkamp |

(Continued)

FOREIGN PATENT DOCUMENTS

| | | | | |
|---|---|---|---|---|
| CA | 2178351 | A1 * | 12/1997 | ..... E04G 21/3219 |
| CA | 2278086 | A1 * | 1/2001 | ..... E04G 21/3219 |

(Continued)

OTHER PUBLICATIONS

EZY Strut E2346 U Fitting HDG.Mar. 23, 2012. http://www.ezystrut.com.au/products/u-fittings-and-base-plates/e2346/e2346h.

*Primary Examiner* — Josh Skroupa
(74) *Attorney, Agent, or Firm* — Hall Estill Law Firm

(57) ABSTRACT

Certain embodiments of the invention surround a reusable construction guardrail or stanchion. In certain embodiments, the reusable construction guardrail has features that aid in easier and faster assembly and disassembly. In certain embodiments of the invention, the construction guardrail is transportable, having telescoping features and folding features to allow greater ease in packing and transporting. Certain embodiments of the invention include a reusable construction guardrail having a uniform construction.

16 Claims, 4 Drawing Sheets

(56) References Cited

U.S. PATENT DOCUMENTS

| | | | | |
|---|---|---|---|---|
| 4,669,577 | A | 6/1987 | Werner | |
| 5,431,372 | A | 7/1995 | Kostelecky | |
| 5,515,941 | A | 5/1996 | Palmer | |
| 5,573,227 | A | 11/1996 | Hemauer | |
| 5,638,917 | A | 6/1997 | Vennen | |
| 5,647,451 | A | 7/1997 | Reichel | |
| 5,683,074 | A | 11/1997 | Purvis | |
| 5,788,204 | A | 8/1998 | Goodwin | |
| 5,842,685 | A | 12/1998 | Purvis | |
| 5,896,944 | A | 4/1999 | McMillian et al. | |
| 6,038,829 | A * | 3/2000 | Franks | E04G 3/26 52/645 |
| 6,053,281 | A | 4/2000 | Murray | |
| 6,279,880 | B1 | 8/2001 | Hawks, Jr. | |
| 6,336,623 | B1 | 1/2002 | McCarthy | |
| 6,585,080 | B2 | 7/2003 | Murray | |
| 6,679,482 | B2 * | 1/2004 | Allenbaugh | E04G 21/3233 182/113 |
| 6,840,015 | B1 | 1/2005 | Ashley | |
| 7,063,186 | B1 | 6/2006 | Granke | |
| 7,127,868 | B2 | 10/2006 | Purvis | |
| 7,234,689 | B2 | 6/2007 | Kuenzel | |
| RE39,842 | E | 9/2007 | Purvis | |
| 7,503,372 | B1 | 3/2009 | Jones | |
| 7,530,551 | B2 | 5/2009 | Kuenzel | |
| 7,806,232 | B2 | 10/2010 | Thomas | |
| 8,132,792 | B2 | 3/2012 | Perris | |
| 8,448,923 | B1 | 5/2013 | Schad | |
| 9,435,131 | B2 | 9/2016 | Miller, Jr. | |
| 9,598,870 | B2 | 3/2017 | Gutierrez | |
| 9,920,540 | B2 * | 3/2018 | Kurtz | E04G 5/062 |
| 2002/0104987 | A1 | 8/2002 | Purvis | |
| 2003/0178613 | A1 | 9/2003 | Purvis | |
| 2005/0247518 | A1 | 11/2005 | Klein | |
| 2006/0249721 | A1 | 11/2006 | Landaker | |
| 2008/0028694 | A1 | 2/2008 | Wasitis | |
| 2009/0159864 | A1 | 6/2009 | Perris | |
| 2014/0263904 | A1 * | 9/2014 | Kozyra | E02D 29/02 248/231.71 |
| 2016/0305152 | A1 * | 10/2016 | Kozyra | E04H 17/22 |

FOREIGN PATENT DOCUMENTS

| | | | | |
|---|---|---|---|---|
| FR | 3002569 | A1 * | 8/2014 | E04G 21/3233 |
| FR | 3019202 | A1 * | 10/2015 | E04G 21/3223 |

* cited by examiner

EXTENDABLE CONSTRUCTION STANCHION

CROSS-REFERENCE TO RELATED APPLICATIONS

This current application claims the benefit of U.S. Provisional Patent Application No. 62/497,017, filed Nov. 7, 2016, which is hereby incorporated by reference.

FIELD OF THE INVENTION

Embodiments of the present invention generally relate to construction equipment, and particularly to a fall-prevention and/or fall-restraining device used during the construction of structures.

BACKGROUND OF THE INVENTION

Guardrails are commonly used at construction sites to prevent access to certain areas. Guardrails commonly provide a physical and visual boundary for construction workers. Guardrails placed along the boundary of an elevated construction site can protect workers from falling or becoming seriously injured.

Occupational Safety and Health Administration (OHSA) regulations 29 C.F.R. 1910.23, 29 C.F.R. 1926.501, and others, describe requirements for fall protection and fall protection systems. Under OHSA regulations, guardrails must be built to withstand, without failure, 200 pounds (890 N) of inward and outward force. Guardrails must also have a height of 42 inches (1.1 m), plus or minus 3 inches (8 cm).

Wooden guardrails provide an inexpensive way to create a boundary. Wooden guardrails are typically assembled at the construction site with available materials (such as 2×4 lumber). However, assembly and disassembly of the wooden guardrails can be tedious and time-consuming. Wooden guardrails are typically heavy and/or cumbersome, and may require more than worker to assembly and disassemble. Wooden guardrails also have a limited useable lifetime, as the material is prone to weathering, degradation, and wear over time. Due to the variability in the type of wood used, type of equipment (e.g. fasteners), and method of construction, wooden guardrails in practice may not be capable of withstanding the minimum force required by OHSA regulations. Therefore, there is a need for a reusable construction guardrail having a uniform construction such that, when assembled, the reusable construction guardrail predictably meets certain OHSA standards.

Reusable guardrails are also available. Examples of reusable guardrail components can be found, for example, in U.S. Pat. No. 3,867,997 to Hyslop, Jr., U.S. Pat. No. 5,431,372 to Kostelecky, U.S. Pat. No. 5,647,451 to Reichel, U.S. Pat. No. 5,896,944 to McMillian, and U.S. Pat. No. 8,132,792 to Penis. However, these guardrail components may be cumbersome to use to allow for quick assembly and disassembly of the guardrail. Some of these guardrail components have features that may pose a tripping or falling hazard. Some of these guardrail components cannot be reduced in size, which makes it difficult to handle and/or transport. Therefore, there is a need for a reusable construction guardrail having features that aid in easier and faster assembly and disassembly. There is also a need for a reusable construction guardrail that is easily reduced in size and easily transported. Additionally, there is a need for a reusable construction guardrail that meets all of the above needs while adhering to OHSA standards.

SUMMARY

It is the object of certain embodiments of the invention to have new and useful features surrounding a reusable construction guardrail or stanchion. In certain embodiments of the invention, the construction guardrail is transportable, having telescoping features and folding features to allow greater ease in packing and transporting.

Certain embodiments of a construction guardrail include a vertical post being able to support one or more horizontal rails. Certain embodiments have a bracket configured to receive a horizontal rail. Certain embodiments further include a spring-actuated handle being able to clamp a horizontal rail. A plurality of construction guardrail embodiments placed next to one another allows a horizontal rail to span such plurality of construction guardrails. Certain embodiments of a vertical post can be telescoped, allowing certain aspects of the vertical post to be extended and retracted. Such telescoping feature can compact the construction guardrail to aid in easier delivery and storage.

Certain embodiments of a construction guardrail include a base plate. A base plate has openings that allow for affixing to various construction surfaces, such as wood and concrete. Certain embodiments of a base plate include openings arranged and configured to accommodate fasteners, allowing for better stability. A base plate includes a surface configured to abut a toe-board. A base plate further includes structural ribs for added strength. A base plate pivotally attached to a vertical post allows further folding and compacting the construction guardrail in certain embodiments.

These and other advantages will be apparent from the disclosure of the inventions contained herein. The above-described embodiments, objectives, and configurations are neither complete nor exhaustive. As will be appreciated, other embodiments of the invention are possible using, alone or in combination, one or more of the features set forth above or described in detail below. Further, this Summary is neither intended nor should it be construed as being representative of the full extent and scope of the present invention. The present invention is set forth in various levels of detail in this Summary, as well as in the attached drawings and the detailed description below, and no limitation as to the scope of the present invention is intended to either the inclusion or non-inclusion of elements, components, etc. in this Summary. Additional aspects of the present invention will become more readily apparent from the detailed description, particularly when taken together with the drawings, and the claims provided herein.

DETAILED DESCRIPTION

Certain embodiments of the invention surround a reusable construction stanchion for assembling a guardrail. In certain embodiments, the reusable construction stanchion has features that aid in easier and faster assembly and disassembly of a guardrail. In certain embodiments of the invention, the construction stanchion is transportable, having telescoping features and folding features to allow greater ease in packing and transporting. Certain embodiments of the invention include a reusable construction stanchion having a uniform construction such that, when assembled, the reusable construction guardrail predictably meets certain OHSA safety standards.

A worker generally uses a stanchion, found in certain embodiments of the invention, to assemble a guardrail. It will be appreciated that a stanchion, in certain embodiments, is used in combination with rails and toe boards, as described herein. It will be appreciated that a rail and toe board is material that is laid on its side, and provides adequate support to adhere with OHSA standards. In certain embodiments, the material that comprises a rail and toe board includes, but is not limited to lumber, and metal.

Figure 1:
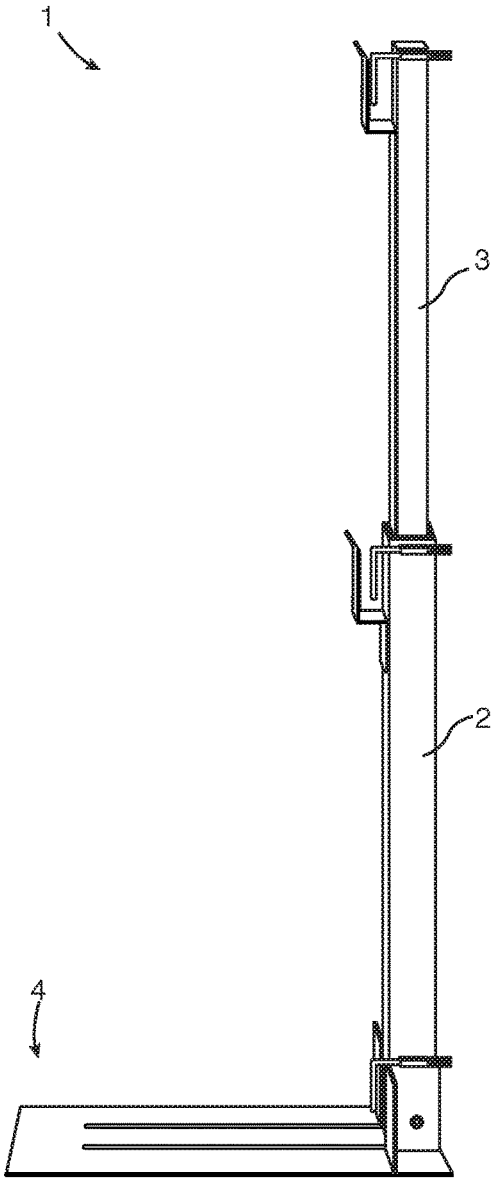
FIG. 1. Certain embodiments of the stanchion in an extended position.
Figure 2A:
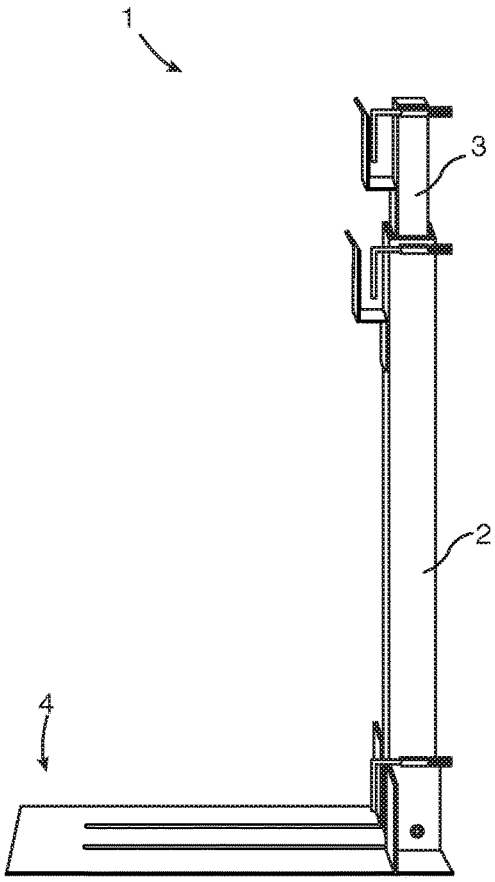
FIG. 2A. Certain embodiments of the stanchion in a retracted position.
Figure 2B:
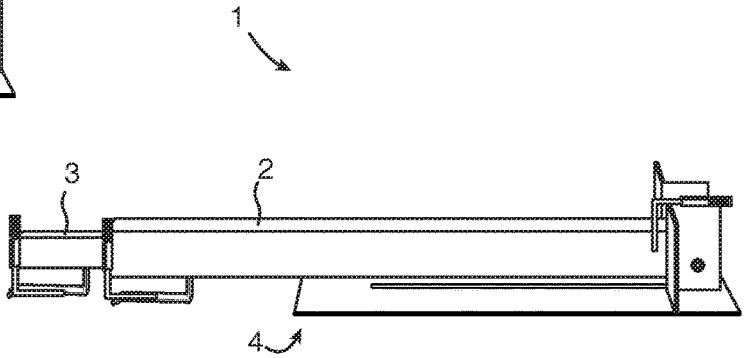
FIG. 2B. Certain embodiments of the stanchion in a folded position.

Referring to FIGS. 1-2, certain embodiments of a stanchion 1 include a vertical post and a base plate. In certain embodiments, a vertical post includes a first post 2 and a second post 3. In certain embodiments, when a stanchion vertical post is extended, the vertical post has a height of approximately 107 cm (42 inches), although other sizes can be used. A vertical post is further attached to a base plate 4. Referring to FIG. 1, an embodiment of a stanchion 1 is extended or telescoped. Referring to FIG. 2A, a stanchion 1 is retracted, and referring to FIG. 2B, a stanchion 1 is further folded. It will be appreciated that, being able to fold and unfold, and extend and retract certain aspects of the stanchion 1 allows for easier and faster assembly and disassembly of a construction guardrail. It will also be appreciated that folding, unfolding, extending, and retracting aspects aid in transporting, stacking, and storing the stanchion 1.

Figure 3:
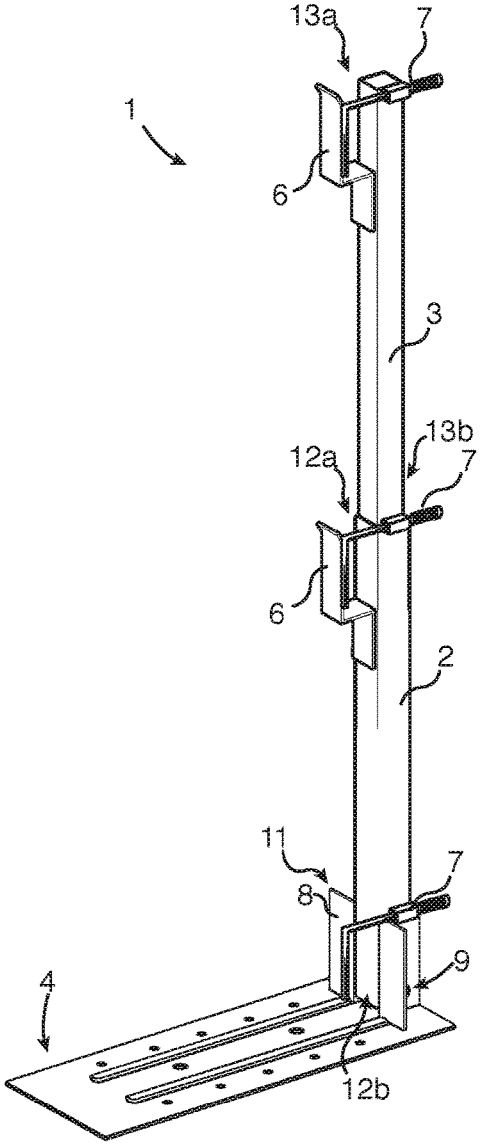
FIG. 3. A perspective view of certain embodiments of the device.
Figure 6:
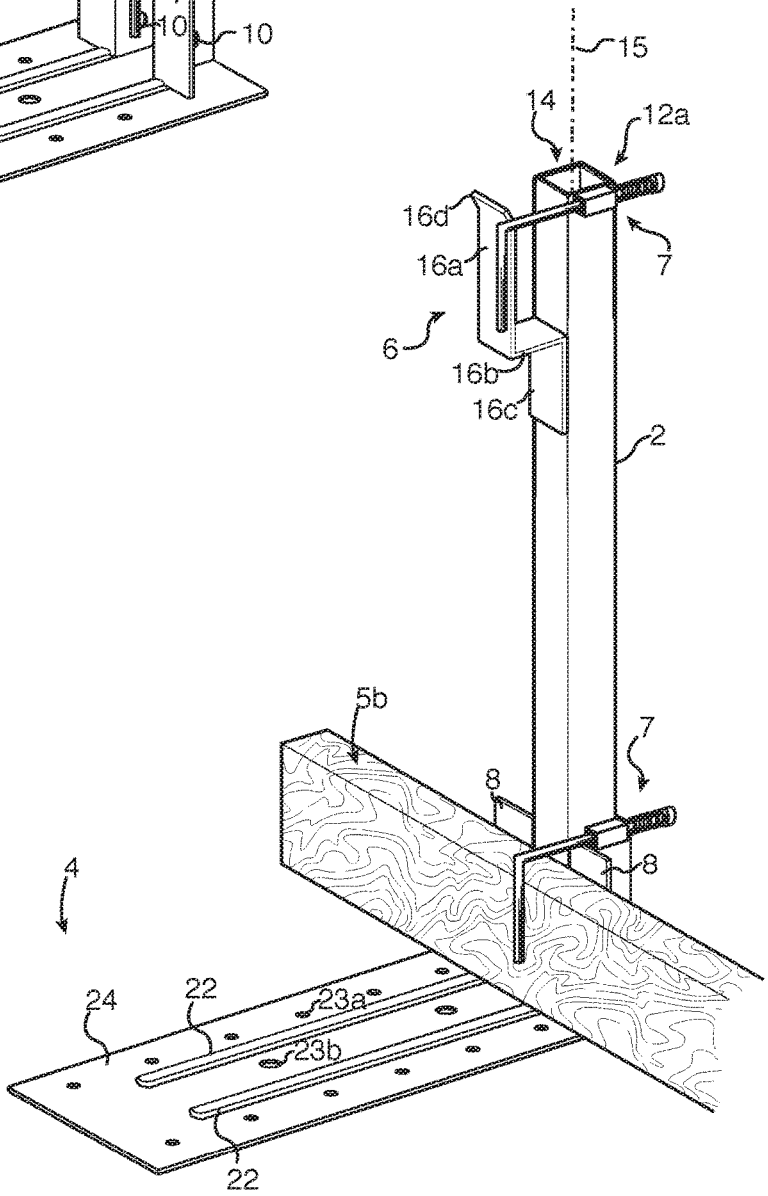
FIG. 6. A perspective view of a base plate, first post, and toe-board in certain embodiments.

Referring to FIG. 3 showing a perspective view, a stanchion 1 includes a first post 2. A first post 2 generally has a first end 12*a* and a second end 12*b*. Referring to FIG. 6, a cavity 14 follows a longitudinal axis 15 and communicates with a first end 12*a*. In certain embodiments, as shown in FIG. 3, a second post 3 second end 13*b* slides through a first post 2 cavity 14. In certain embodiments, a second post is oriented in a parallel direction with the longitudinal axis 15. In certain embodiments, a first post 2 has a bracket 6 proximal to the first end 12*a*. In certain embodiments, a second post 3 has a bracket 6 proximal to the first end 13*a*. Still referring to FIG. 3, embodiments of a stanchion include brackets 6 located on the same side of a first post and second post. It will be appreciated that a bracket 6 may be found on any surface of a first post and second post. It will also be appreciated that one or more brackets may be found on a stanchion, a first post, and a second post.

Figure 4:
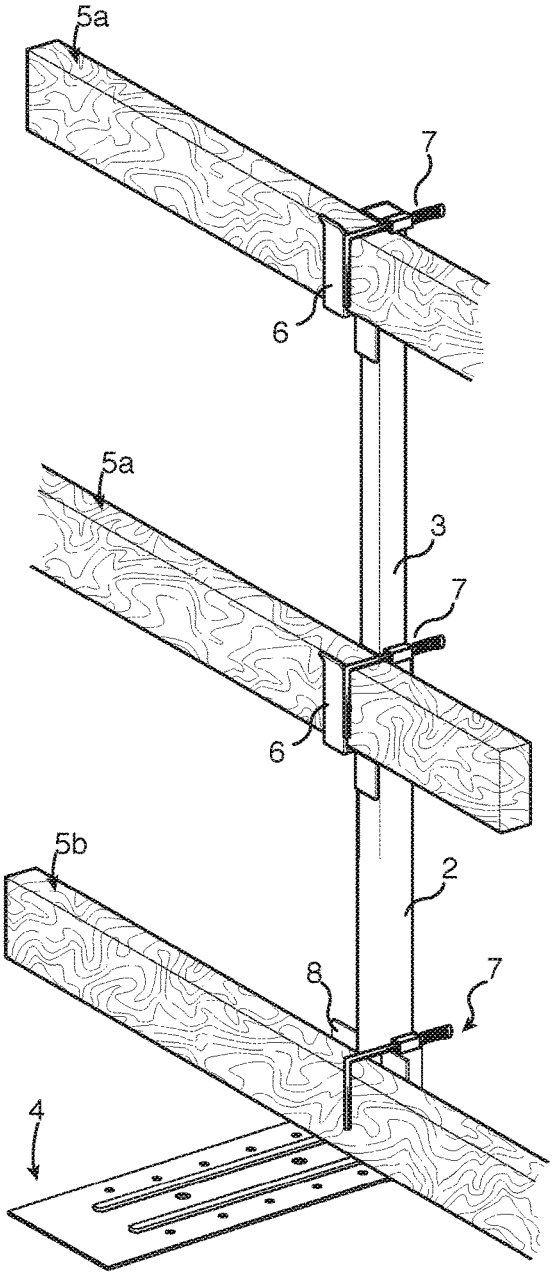
FIG. 4. A perspective view of certain embodiments of the device with rails and toe board.

Referring to FIG. 4, a bracket 6 is generally configured to receive a rail 5*a*. A bracket 6 allows a rail to be laid horizontally. In certain embodiments, as shown in FIG. 6, a bracket 6 further includes a side wall 16*a* and a bottom wall 16*b*. A rail is held in place by the surfaces of the side wall 16*a*, bottom wall 16*b*, and a post. Certain embodiments of a bracket 6 further include a mounting wall 16*c*, allowing attachment to the vertical post. Certain embodiments also include a lip 16*d* that assists in guiding a rail into position. As shown for example in FIGS. 3-4, in certain embodiments, a bracket 6 is disposed on both a first post 2 and second post 3.

Figure 7:
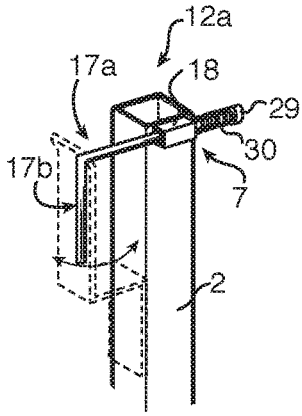
FIG. 7. A close-up view of a retention handle.

In certain embodiments, a retention handle 7 is proximally located to a bracket 6. Referring to FIG. 7 certain embodiments of a retention handle 7 is spring-actuated, further having a pin portion 17*a*, and a handle portion 17*b*. A pin portion 17*a* is rotatable and slideable within a sleeve 18. A spring member provides an elastic restoring force when a retention handle is displaced. A spring member 30 having a stop against the sleeve 18 with a pin stop 29, in certain embodiments, provides such spring-actuated mechanism. In certain embodiments, a retention handle 7 retains a rail 5*a* and toe board 5*b*. It will be appreciated by those skilled in the art that this example of a retention handle is merely exemplary, and other types of spring-actuated mechanisms may be used.

Referring to FIG. 4, in certain embodiments, a guard rail is assembled by placing rails 5*a* in a bracket. A retention handle 7 is temporarily pulled and/or rotated to provide adequate space between a bracket 6 and post. A worker then slides a rail into a bracket 6. Once a rail is in position, a retention handle 7 is released, whereby a spring-actuated retention handle 7 provides a compressive force to secure the rail.

Referring to FIG. 6, it will be appreciated that the length of the bottom wall 16*b* of a bracket 6 can generally be any size to accommodate rails of various sizes. It will also be appreciated that a bracket 6 accommodates any number of rails at once. In certain embodiments, a bracket 6 and retention handle 7 have dimensions to hold one or more lumber pieces (e.g. 2 by 4).

Figure 5:
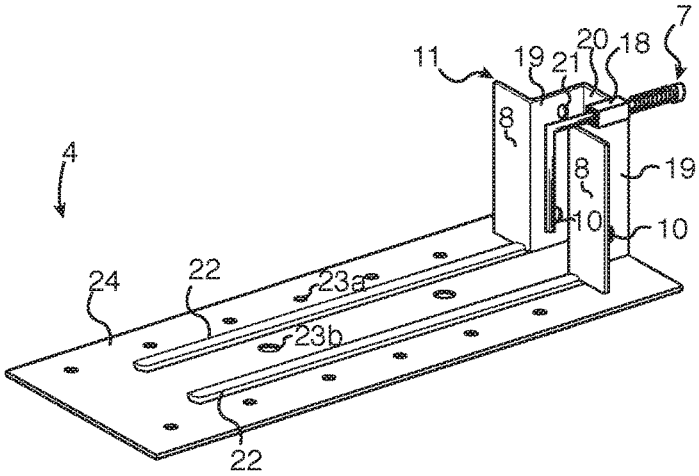
FIG. 5. A base plate in certain embodiments of the invention.

Referring to FIG. 5 and FIG. 6, a stanchion 1 includes a base plate 4. Embodiments of a base plate 4 include a plate 24 that is relatively flat as to keep it from being a tripping hazard. Embodiments of a plate 24 also include a rib 22 to strengthen the base plate. A rib 22 includes for example, a bend in the base plate material created during the manufacturing process, or additional material welded to the base plate. Generally, a bend in the base plate material provides stiffness in the material. A rib is generally oriented lengthwise on a plate 24, although it will be appreciated that any number of ribs may be laid in any direction to generally strengthen the base plate. In certain embodiments, for example, two ribs may cross to form an "X" shape.

Still referring to FIG. 5 and FIG. 6, a base plate further includes openings 23*a*, 23*b*. Openings provide a through-hole so that fasteners may be used to secure the plate 24 to a working surface. A working surface may include, for example, plywood, and concrete. In one example, as shown in FIG. 5 and FIG. 6, openings 23*b* configured for concrete fasteners are located towards the middle of a plate 24, while openings 23*a* configured for wood fasteners are located towards the perimeter of a plate 24. It will be appreciated that openings 23*a*, 23*b* of various sizes are provided on a plate 24 to allow different sized fasteners to be used for an appropriate surface. In certain embodiments, these openings may be provided with sizes that are 0.3175 cm (⅛ inch) and 1.275 cm (½ inch), although other opening sizes may be provided.

Referring to FIG. 3 and FIG. 5, a base plate 4 is attached to a frame 11. In certain embodiments of the invention, a frame provides a number of functions for a stanchion. For example, a frame provides a pivot point 9 (seen in FIG. 3) for a post to fold into a base plate. A frame provides a platform for a locking pin, to lock a vertical post into position. A frame also controls the angle to which the post is able to fold. A frame also provides a surface for a toe-board to abut.

Referring to FIG. 5, certain embodiments of a frame 11 include two support walls 19 placed in a parallel orientation. It will also be appreciated that in other embodiments, support walls are oriented obliquely, or other orientations besides parallel. Certain embodiments have a back wall 20 further attached to the support walls 19. A back wall, in certain embodiments, restricts the folding of a vertical post relative to the base plate Pin openings 10 are located on the support walls 19, and a vertical post has a corresponding opening 26 (seen in FIG. 8) that provides a through-channel for a hinge pin 25. In one example shown in FIG. 8, a first post 2 is disposed between the support walls 19, where a hinge pin 25 communicates between the pin openings 10 and through the corresponding first post opening 26, allowing the vertical post to pivot relative to the base plate 4. Moreover, referring to FIG. 5, a sleeve 18, which houses a retention handle 7, is attached to a frame 11 (for example, on a support wall 19).

It will be appreciated that a base plate and vertical post are attached by other configurations known to those skilled in the art. In certain embodiments of the invention, a base plate and vertical post are pivotably attached, allowing folding and unfolding. It will be appreciated that any type of hinge or pivot known to those skilled in the art is used to pivot a vertical post relative to a base plate.

Still referring to FIG. 5, certain embodiments of a frame 11 have a planar surface 8. Referring to FIG. 6, a toe board 5*b* may be laid on a base plate 4, and further abutted against a planar surface 8. In certain aspects, a planar surface provides a surface for a toe board 5*b* to be laid against.

Referring to FIG. 4 and FIG. 6, a toe board 5*b* is laid on a base plate 4 and against a planar surface 8 in certain embodiments. A retention handle 7 is pulled to introduce a restoring force in a spring. A worker then slides a toe board 5*b* against the base plate 4. Once a toe board 5*b* is in position, a retention handle 7 is released, where a retention handle 7 provides a compressive force to secure the toe board 5*b* to the base plate 4.

Figure 8:
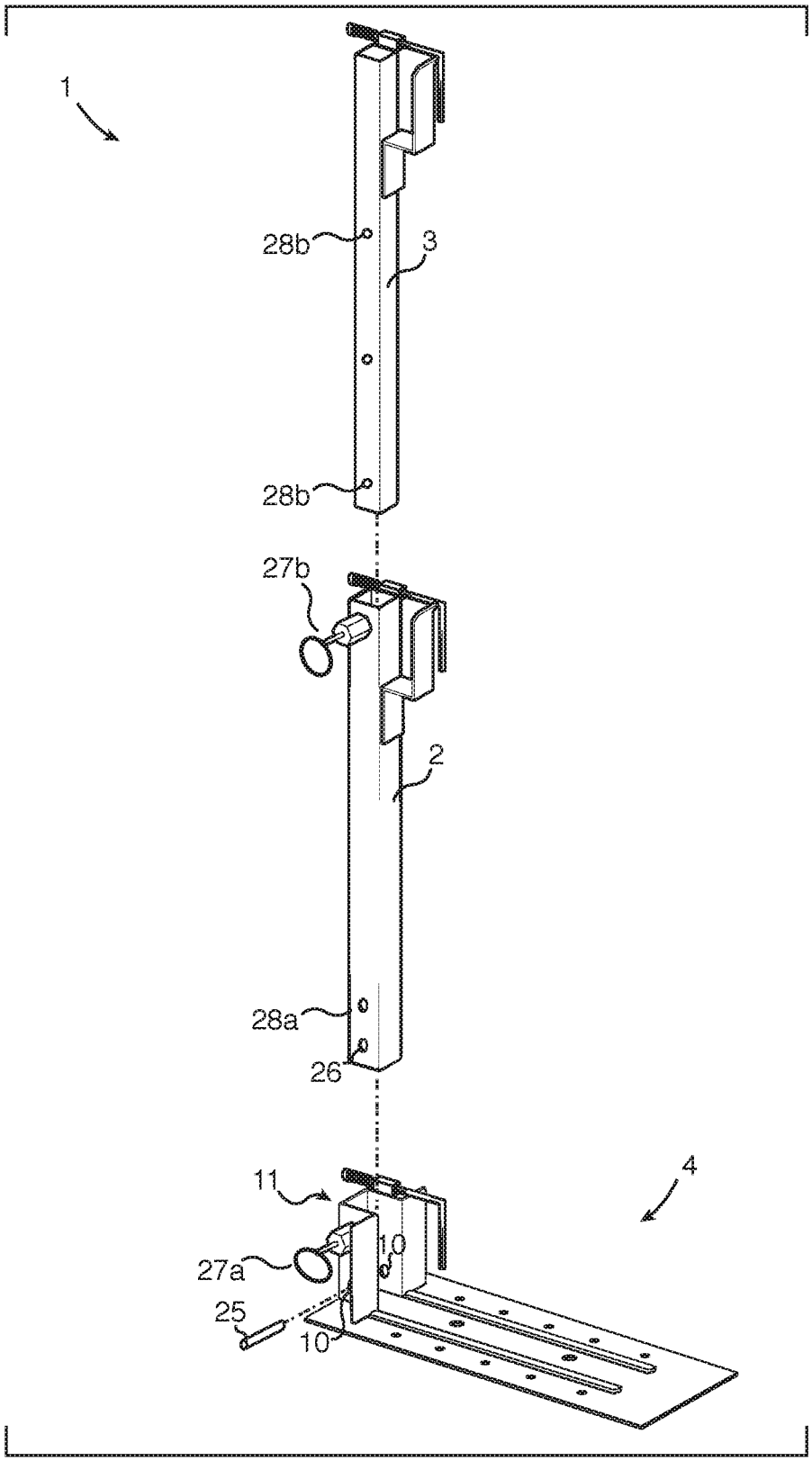
FIG. 8. An exploded view of a stanchion, including the base plate, first post, and second post in certain embodiments.

Referring to FIG. 2A, a vertical post is telescoped by sliding a second post 3 relative to the first post 2. Referring to FIG. 8, in certain embodiments, a second post 3 is placed through first post 2. A second post 3 has a retention hole 28*b*, and as shown in FIG. 8, has a plurality of retention holes along its length. A first post 2 has a corresponding retention pin 27*b*, where a pin member protrudes into a cavity 14 (seen in FIG. 6) of the first post 2. A retention pin 27*b* restricts movement of the second post 3 when the retention pin 27*b* pin member is aligned and mated with a retention hole 28*b*. It will be appreciated that a retention pin is attached to a component described herein, for example, a frame and a vertical post. It will also be appreciated that in other embodiments, the second post has a cavity, and the second post slides over the first post. In such embodiment, the second post has a retention pin pin member mateable with a retention hole located on the first post.

In certain embodiments, a retention pin 27*a*, 27*b* is spring-actuated, such that pulling the spring-actuated pin releases the pin member from a retention hole. In certain embodiments, release of a retention pin 27*b* allows slideable movement of the second post 3.

Still referring to FIG. 8, a base plate 4 frame 11 has a retention pin 27*a*. A retention pin 27*a* mates with the corresponding retention hole 28*a* located on a vertical post, for example, the first post 2. A retention pin 27*a* includes a pin passing through a retention pin opening 21 (seen in FIG. 5). When the vertical post and base plate are in an open position (seen for example in FIG. 1), the retention pin 27*a* restricts the movement of the vertical post. Releasing the retention pin 27*a* (for example, by pulling the spring-actuated retention pin) from the corresponding retention hole 28*a* allows the stanchion 1 to be folded (seen for example in FIG. 2B).

It will be appreciated that the apparatus and features described herein may be made of materials metallic, polymeric, plastic, inorganic, synthetic, and natural. These materials include, but is not limited to, metals and alloys, such as steel, stainless steel, galvanized metals, copper, copper alloys, nickel, nickel alloys, iron, iron alloys, aluminum, titanium, and other alloys thereof, combinations thereof, and/or other equivalent material intended for assembling a guardrail. In certain embodiments, the stanchion may also include materials plastic, including, but not limited to, PVC and HDPE.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the inventions described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

The invention claimed is:

1. An apparatus for a guardrail assembly, comprising:

a vertical post aligned with a longitudinal axis, said vertical post further comprising:

a first post aligned with said longitudinal axis, the first post having a first end and a second end, wherein a first sleeve is positioned at the first end of the first post, a second post, said second post defining a body disposed parallel with said longitudinal axis and slidable relative to said first post, the second post having a first end and a second end, wherein a second sleeve is positioned at the first end of the second post; and a retention pin mateable with a retention hole, said retention pin and said retention hole restrict said second post sliding relative to said first post;

a base plate, said base plate pivotably attached to said vertical post;

a bracket comprising a bottom wall, said bottom wall extending from the post longitudinal axis, and a side wall; said bracket attached to said vertical post; and at least one retention handle, said at least one retention handle located proximal to said bracket, wherein a portion of the retention handle is positioned through the first sleeve of the first post or the second sleeve of the second post.

2. The apparatus in claim 1, wherein said base plate further comprises a rib.

3. The apparatus in claim 1, further comprising a second retention pin mateable with a second retention hole, said second retention pin mates said second retention hole, said second retention pin restricts pivoting said base plate from said vertical post.

4. The apparatus in claim 3, further comprising a frame, said frame attached to said base plate, said vertical post pivotably attached to said frame.

5. The apparatus in claim 4, said frame further comprises a planar surface, and said at least one retention handle located proximal to said planar surface, said planar surface configured to abut a toe board, and said at least one retention handle configured to retain said toe board to said frame.

6. The apparatus in claim 1, wherein said retention handle is spring actuated.

7. The apparatus in claim 1, wherein said retention pin is spring-actuated.

8. The apparatus in claim 1, wherein said first post defines a first end and a second end, a cavity following said longitudinal axis and communicating with at least said first post first end, said base plate pivotably attached to said first post second end, and said at least one bracket is attached proximal to said first post first end.

9. The apparatus in claim 8, wherein said second post is slidable within said first post cavity, and wherein said at least one said bracket is attached to said second post.

10. An apparatus for a guardrail assembly, comprising:

a vertical post aligned with a longitudinal axis and having a first end and an opposing second end, said vertical post further comprising:

a first post, the first post having a first end and a second end, wherein a first sleeve is positioned at the first end of the first post, said first post aligned with said longitudinal axis, a cavity following said longitudinal axis and communicating with at least said first end, and a second post, the second post having a first end and a second end, wherein a second sleeve is positioned at the first end of the second post, said second post defining a body disposed parallel with said longitudinal axis and slidable within said first post cavity, wherein said first post second end is coincident with said vertical post second end;

a base plate, said base plate pivotably attached to said vertical post second end; and a first bracket comprising a bottom wall extending from the post longitudinal axis, and a side wall, wherein said first bracket is attached to said vertical post; and a retention handle, said retention handle located proximal to said first bracket, wherein a portion of the retention handle is positioned through the first sleeve of the first post or the second sleeve of the second post.

11. The apparatus in claim 10, further comprising a second bracket attached to said vertical post first end, and a third bracket attached to said first post first end.

12. The apparatus in claim 10, wherein said first post further comprises a first retention pin, and said second post further comprises a first retention hole, said first retention pin mateable with said first retention hole and adapted to restrict movement between said first post and said second post.

13. The apparatus in claim 12, wherein said first retention pin is spring-actuated.

14. The apparatus in claim 10, further comprising a second retention pin mateable with a second retention hole, said second retention pin and said second retention hole restricts pivoting said base plate from said vertical post.

15. The apparatus in claim 14, wherein said retention handle is spring-actuated.

16. The apparatus in claim 10, wherein said base plate further comprises a rib.

* * * * *